US005850588A

United States Patent [19]

Yoshikawa

[11] Patent Number: 5,850,588

[45] Date of Patent: Dec. 15, 1998

[54] IMAGE FORMING APPARATUS HAVING AN IMPROVED WEB TYPE CLEANING DEVICE FOR A FIXING ROLLER

[75] Inventor: Takahiro Yoshikawa, Sagamihara, Japan

[73] Assignee: Ricoh Company, Ltd., Tokyo, Japan

[21] Appl. No.: 889,755

[22] Filed: Jul. 10, 1997

[30] Foreign Application Priority Data

Jul. 10, 1996 [JP] Japan ..... 8-180966

[51] Int. Cl.[6] ..... G03G 15/20; G03G 21/00

[52] U.S. Cl. ..... 399/327; 399/71

[58] Field of Search ..... 399/327, 67, 71, 399/33, 34, 9; 15/265.5, 256.51, 256.52

[56] References Cited

U.S. PATENT DOCUMENTS

| | | | |
|---|---|---|---|
| 4,179,211 | 12/1979 | Kimura et al. | 399/327 X |
| 4,557,588 | 12/1985 | Tomosada | 399/71 X |
| 5,168,314 | 12/1992 | Gunji et al. | 399/327 |
| 5,402,211 | 3/1995 | Yoshikawa . | |
| 5,559,591 | 9/1996 | Kato et al. | 399/327 |

FOREIGN PATENT DOCUMENTS

| | | |
|---|---|---|
| 63-70882 | 3/1988 | Japan . |
| 2-062559 | 3/1990 | Japan . |
| 2-280181 | 11/1990 | Japan . |
| 2-284184 | 11/1990 | Japan . |
| 4-014082 | 1/1992 | Japan . |
| 5-204274 | 8/1993 | Japan . |
| 8-241007 | 9/1996 | Japan . |

*Primary Examiner*—Sandra L. Brase
*Assistant Examiner*—Sophia S. Chen
*Attorney, Agent, or Firm*—Oblon, Spivak, McClelland, Maier & Neustadt, P.C.

[57] ABSTRACT

An image forming apparatus is provided with a web type cleaning device for cleaning a fixing roller of a fixing device. The cleaning device has a web roller having a web wound therearound and a web winding roller to wind the web unwound from the web roller. A part of the web unwound from the web roller is pushed by a pushing device, including a spring member, against the fixing roller with a relatively small pushing force. When the fixing roller rotates, the heating roller is cleaned by the web contacting the heating roller. After a predetermined number of copies are completed and when the heating roller is not rotating, the web is wound by the web winding roller to change the portion contacting the fixing roller.

19 Claims, 5 Drawing Sheets

IMAGE FORMING APPARATUS HAVING AN IMPROVED WEB TYPE CLEANING DEVICE FOR A FIXING ROLLER

BACKGROUND OF THE INVENTION

1. Field of the Invention

The present invention relates to an image forming apparatus having a web type cleaning device for a fixing roller for fixing a toner image formed on a copysheet by using heat.

2. Discussion of the Background

In a background image forming apparatus, a toner image formed on a copysheet is fixed by a fixing device when the copysheet passes through the fixing device. The fixing device generally includes a pair of fixing rollers including a heating roller and a pressing roller, and the copysheet passes between the heating roller and the pressing roller. The toner is heated by the heating roller and is pressed by the pressing roller to be fixed. In such a fixing device, all of the toner on a copysheet is not entirely fixed onto the copysheet by the fixing device. As a result, some portion of the toner melted by the heating roller adheres to the heating roller. Then, such toner adhering to the heating roller is transferred to a next copysheet, thereby disturbing the toner image on the next copysheet when the next copysheet passes through the fixing device. Therefore, generally, a cleaning device for cleaning the heating roller is included in the fixing device of such a background image forming apparatus.

As an example of a cleaning device for cleaning a heating roller, a background web type cleaning device is illustrated in FIG. 7. As shown in FIG. 7, the background web type cleaning device includes a web 80 for cleaning a heating roller 86, a web roller 82 having the web 80 rolled therearound, a web winding roller 84 for winding the web 80 as it unwinds from the web roller 82, a pushing roller 88 for pushing the web 80 against the heating roller 86, and a spring member 90 for always pushing the pushing roller 88 against the heating roller 86. The heating roller 86 includes a heating element 92 for heating the heating roller 86. When fixing a toner image, the heating roller 86 is rotated by a motor (not shown) and pressed by a pressure roller 94, and a surface of the heating roller 86 is cleaned by the web 80 contacting a surface of the heating roller 86.

In such a background web type cleaning device, the web 80 is wound by the web winding roller 84 to change the portion of the web 80 contacting the heating roller 86 when the contact portion of the web 80 is stained by toner.

For example, there is disclosed in the Japanese Laid-Open Patent Application No. 2-280181, a technology that a motor for rotating such a web winding roller is driven to change the portion of the web contacting the heating roller when a predetermined number of copies are made for avoiding waste of the web on the assumption that the web is stained after such a predetermined number of copies are made.

Further, in a background technology a web winding roller is controlled to stop rotating depending on an electrical current flowing in a motor for rotating the web winding roller to avoid a mechanical trouble of the motor. For example, a rotation of the web winding roller is stopped when a current above a predetermined electrical current level flows in the motor for rotating the web winding roller.

In such background devices, the pushing roller 88 is strongly pressed by the spring member 90 against the heating roller 86 through the web 80 to avoid leakage of a residual toner 96 scraped off by the web 80 and retained in a cleaning area as shown in FIG. 7. If the cleaning web 80 is wound by the web winding roller 84 during rotation of the heating roller 86, since the cleaning web 80 and the heating roller 86 are oppositely moving or rotating contacting each other, either or both of the pressing roller 88 and/or the heating roller 86 may start to vibrate, and as a result, a cleaning gap is formed between the cleaning web 80 and the heating roller 86. Consequently, it occurs that residual toner 96 scraped off the heating roller 86 by the web 80 and retained in the cleaning area (see FIG. 7) is pulled out by a rotational force of the heating roller 86 through the gap and is dropped onto a next copysheet and is fixed thereon by the fixing device, thereby damaging the image on the next copysheet.

Further, a relatively large torque of the motor for rotating the web winding roller 84 is needed when winding the web 80 around the web winding roller 84 because the pushing roller 88 strongly presses the web 80 against the heating roller 86. Accordingly, a large amount of electricity is spent for rotating the web winding roller 84.

Further, if the pushing roller 88 is made of a rubber, a lifetime of the pushing roller 88 becomes relatively short because the roller 88 is transformed by being strongly pressed against the heating roller 86.

Further, when a user mainly makes a copy of a letter image and rarely makes a copy of a picture image, the web 80 is not stained as much even after the predetermined number of copies are made, because a letter image generally consumes a less amount of toner to be developed than a picture image. Therefore, a same portion of the web 80 contacting the heating roller 86 can be used for cleaning the heating roller 86 for a much larger number of copies of letter images than the predetermined number of copies which is generally determined based on a certain mixture ratio of letter and picture images. Accordingly, if the web 80 is automatically wound to change the contact portion of the web 80 each time when the predetermined number of copies are made, the web 80 is wasted.

Further, it is relatively difficult to differentiate an abnormal current accidentally flowing in the motor for rotating the web winding roller 84 from an inrush current flowing every beginning of a driving of the motor, sometimes resulting in an unnecessary stoppage of the motor.

SUMMARY OF THE INVENTION

The present invention has been made in view of such problems and to address and resolve such problems. Accordingly, it is an object of the present invention to provide a novel image forming apparatus which is capable of avoiding a problem that residual toner scraped off a fixing roller by a cleaning device for the fixing roller using a web drops onto a copysheet and damages a toner image thereon.

It is another object of the present invention to solve the above-mentioned problems without using a needless large torque for rotating a web winding roller for avoiding consuming a large amount of electricity for rotating the web winding roller.

It is still another object of the present invention to solve the above-mentioned problems while allowing a pushing roller to still have a long life.

It is still another object of the present invention to solve the above-mentioned problems while avoiding wasteful use of a web for cleaning a heating roller for pushing a web against a fixing roller.

It is still another object of the present invention to solve the above-mentioned problems while avoiding unnecessary stoppage of a motor for rotating a web winding roller due to an inrush current in the motor.

To achieve the above and other objects, an image forming apparatus is improved with a novel fixing device for cleaning the fixing roller.

The novel cleaning device includes a web roller having a web wound therearound. A web winding roller winds the web unwound from the web roller. A part of the web unwound from the web roller and winding around the web winding roller is pushed by a pushing member against a fixing roller. When the fixing roller rotates, the fixing roller is cleaned by the web contacting the fixing roller. A controller is provided for controlling the motor to rotate the web winding roller when a predetermined number of copies are made and the fixing roller is not rotated and stops the rotation of the web winding roller after a predetermined time elapses.

Further, the controller periodically controls the motor to rotate the web winding roller for a longer time than the predetermined time and a current sensor starts sensing a current flowing in the motor after the predetermined time elapses, so that an abnormal current flowing in the motor is detected to stop the rotation of the web winding roller when an abnormal current is detected.

An end portion of the web is adhered to the web roller by an adhesive material with a predetermined adhesive force, and the controller controls the motor for rotating the web winding roller to stop the rotation when a current corresponding to the adhesive force is sensed by the sensor.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
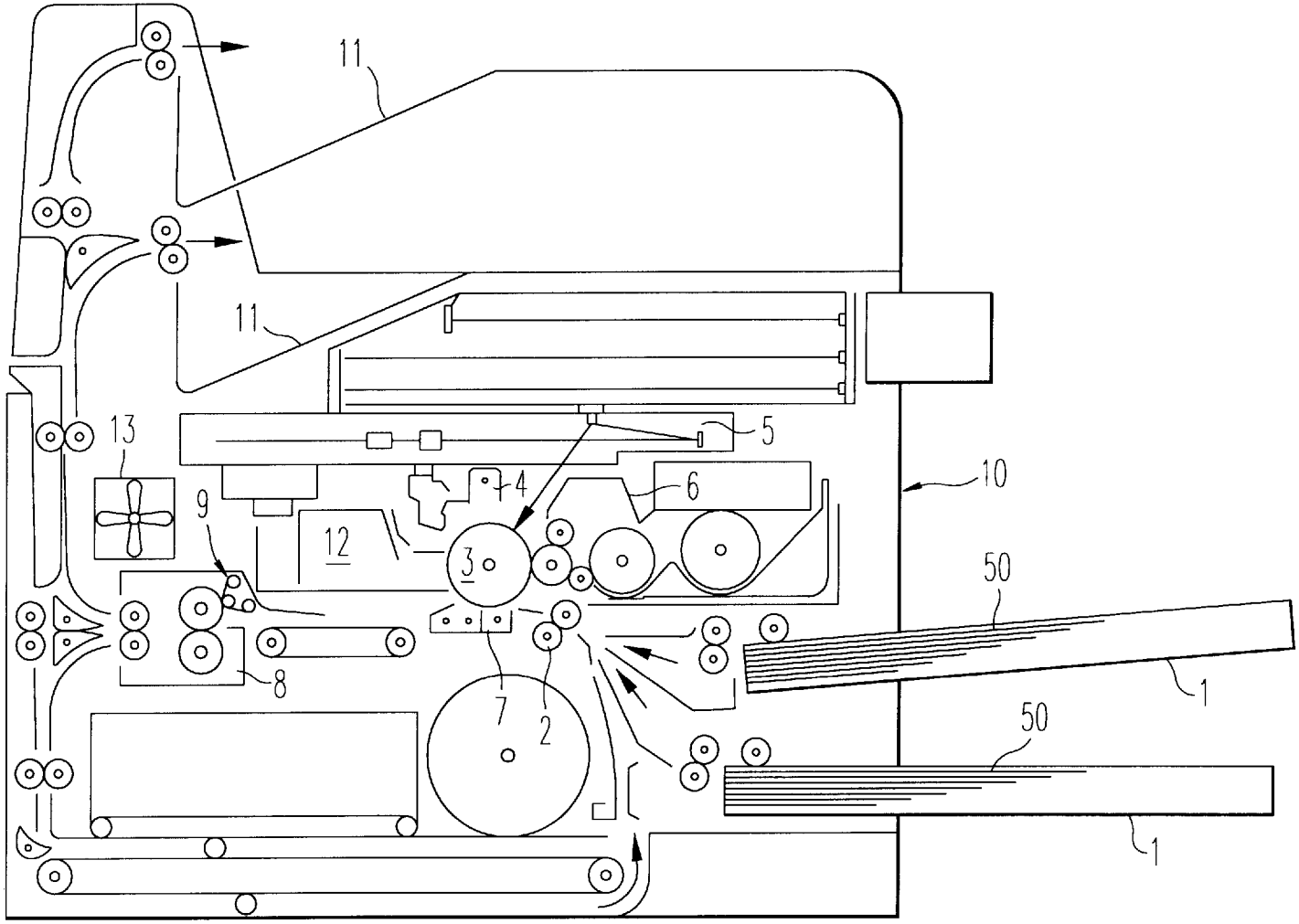
FIG. 1 is a schematic sectional view of an image forming apparatus of the present invention, having a web type cleaning device for a fixing device.

Hereinafter, an embodiment of the image forming apparatus of the present invention is described referring to FIGS. 1 to 6, in which identical reference numerals indicate identical or corresponding parts.

As shown in FIG. 1, a printer 10 as an example of the image forming apparatus is illustrated.

In FIG. 1, the printer 10 includes copysheet cassettes 1 each accommodating a stack of copysheets 50 therein. Each of the copysheets 50 is separated from the other copysheets 50 by a separating roller and is fed out from the copysheet cassettes 1 sheet by sheet. Registration rollers 2 are disposed downstream of the copysheet cassettes 1. The printer 10 includes a photoconductive drum (hereinafter referred to as a P.C. drum) 3 for forming a toner image thereon by a conventional electrographic process. The registration rollers 2 feed the copysheet 50 to the P.C. drum 3 at a predetermined timing for properly transferring a toner image formed on the P.C. drum 3 onto the copysheet 50. The P.C. drum 3 is rotated clockwise by a motor (not shown). The printer 10 further includes a charger 4 for uniformly charging a surface of the P.C. drum 3 with a predetermined polarity. The charger 4 is disposed adjacent to the P.C. Drum 3. The printer 10 includes a laser beam generator 5 for generating and irradiating a laser beam onto a circumferential surface of the P.C. drum 3 to form an electrostatic latent image thereon.

Further, the printer 10 includes a developer 6 for developing the latent image adjacent to the P.C. drum 3. A transfer charger 7 for transferring the toner image on the P.C. drum 3 onto the copysheet 50 is disposed at a position adjacent to the P.C. drum 3 downstream of the developer 6. Such a position is referred to as a transfer position.

The transfer charger 7 charges a predetermined polarity to a back side of a copysheet 50 passing through the transfer position to transfer the toner image onto the copysheet 50 from the P.C. drum 3.

The printer 10 further includes a fixing device 8 for fixing the toner transferred by the transfer charger 7 onto the copysheet 50. The fixing device 8 includes a pair of fixing rollers for fixing the toner image transferred onto the copysheet 50, which is disposed downstream of the transfer position. Copy exit trays 11 are disposed for receiving the copysheet 50 with the toner image thereon as outlets for the copysheet 50 on a top of the printer 10.

The printer 10 further includes a cleaning device 9 disposed adjacent to the fixing device 8 for cleaning the fixing roller of the fixing device 8. Further, a P.C. drum cleaning device 12 is disposed adjacent to the P.C. drum 3 and downstream of the transfer position for removing residual toner from the surface of the P.C. Drum 3. Numeral 13 denotes an exhausting fan for exhausting air in the printer 10 to outside of the printer 10. The printer 10 further includes an operation panel 38 on a top surface.

Figure 2:
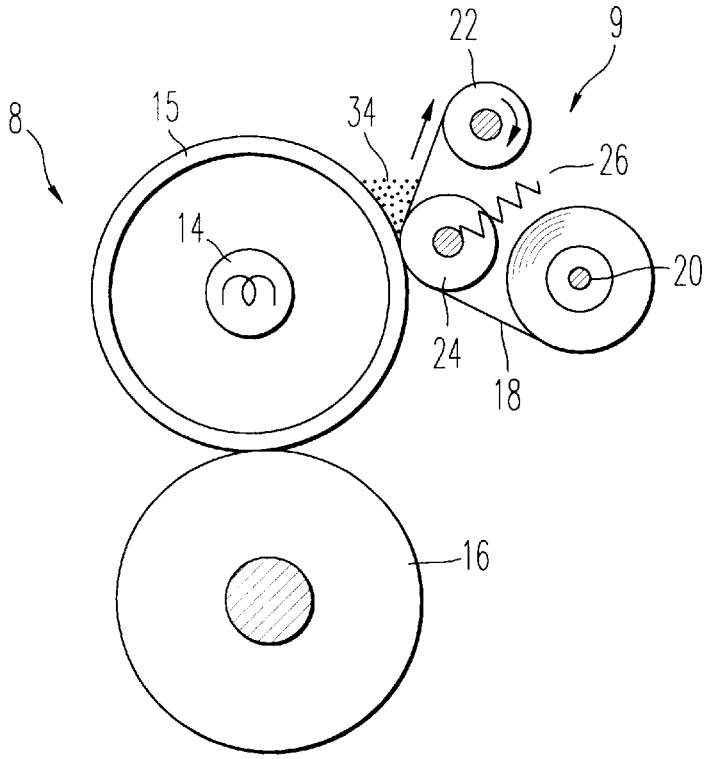
FIG. 2 is a schematic sectional view of the fixing device, having the web type cleaning device for the fixing roller, which is used in the image forming apparatus shown in FIG. 1.

As shown in FIG. 2, the fixing device 8 includes a heating roller 15 driven by a motor (not shown) and a pressing roller 16 driven by the heating roller 15 and pressing a copysheet 50 passing between the heating roller and the pressing roller 16 against the heating roller 15. A heating element 14 is disposed in the heating roller 15 for heating the heating roller 15 to keep the temperature thereof within a predetermined range.

The fixing roller cleaning device 9 includes, as shown in FIG. 2, a web 18 formed in a roll and wound around a web roller 20. The web 18 is composed of a cloth impregnated with a silicon oil or the like and having a heat resistance. The cleaning device 9 further includes a web winding roller 22 having a connecting portion thereon for connecting a leading portion of the web 18. The web winding roller 22 winds the web 18 when a contact portion of the web 18 contacting the heating roller 15 becomes stained by toner. A motor 32 (see FIG. 3) is provided for rotating the web winding roller 22. Further, a web pushing device 26 is provided for pushing the web 18, which is unwound from the web roller 20 and which is expanded between the web winding roller 22 and the web roller 20, against a surface of the heating roller 15. The web pushing device 26 includes a pushing roller 24 and a spring member 26, and is disposed adjacent to the heating roller 15.

Figure 3:
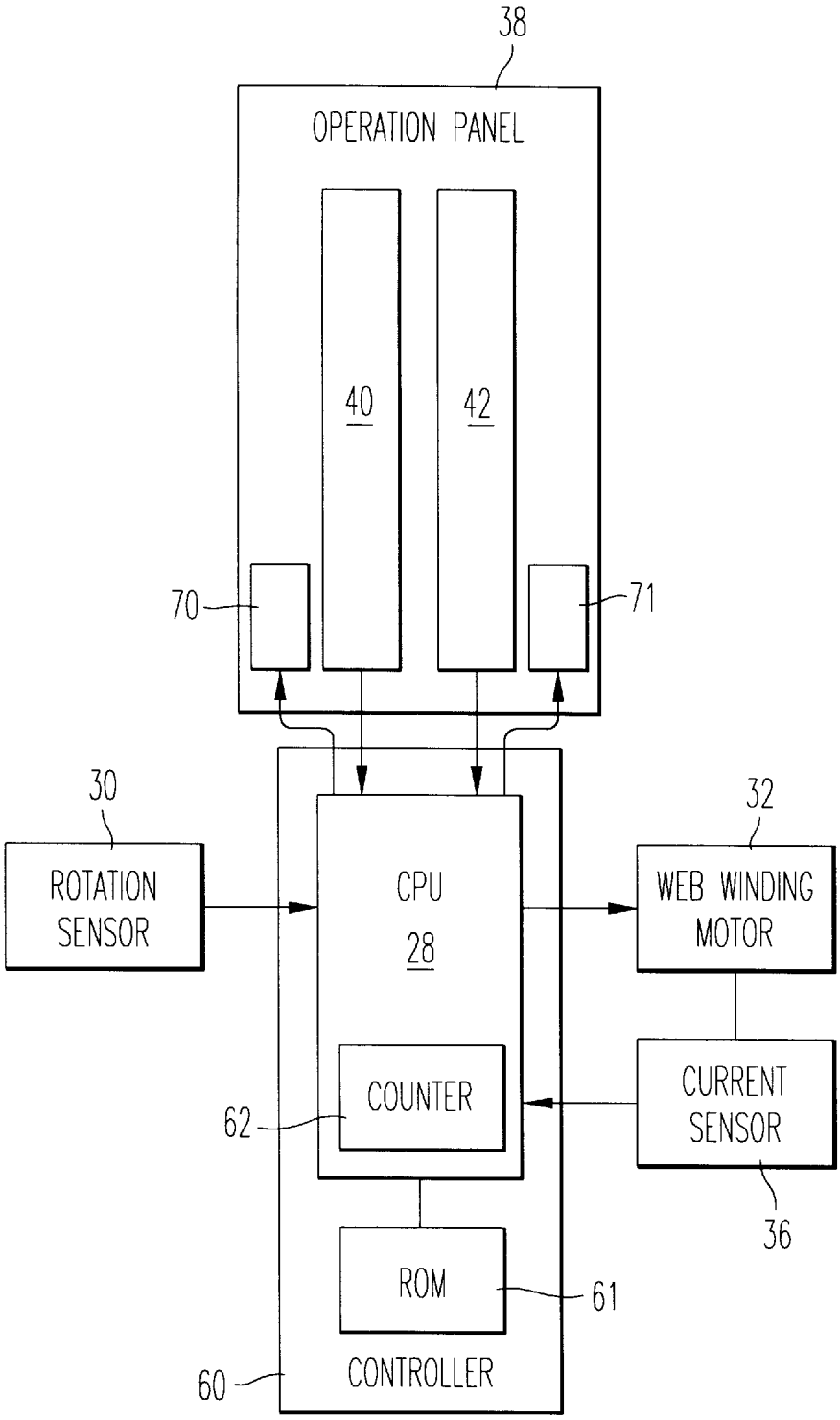
FIG. 3 is a block diagram showing a controller of the web type cleaning device shown in FIG. 2.

As shown in FIG. 3, the image forming apparatus of the present invention further includes a controller 60 for controlling the motor 32 for rotating the web winding roller 22. The controller 60 includes a CPU 28 for controlling the motor 32 and a counter 62 for counting the number of copies are made. The controller 60 controls the motor 32 for rotating the web winding roller 22 to start driving thereof when a predetermined number of copies are made and to keep driving the motor 32 until a predetermined length of the web 18 is wound by the web winding roller 22 to change a contact portion of the web 18 contacting the heating roller 15 with the predetermined length.

The controller 60 further includes a ROM 61 to store therein information for controlling the motor 32, such as, a number of copies used as a reference for a start of the web winding roller 22 which will be explained later.

The image forming apparatus further includes a rotation sensor 30 for sensing a rotation of the heating roller 15. A signal generated by the rotation sensor 30 is input to a CPU 28. The apparatus further includes a current sensor 36 for sensing a current flowing in the motor 32 for rotating the web winding roller 22. A signal generated by the current sensor 36 is input to the CPU 28.

The aforementioned operation panel 38 includes a web winding start timing setting key 40 for setting a number of copies which is used as a reference for start of rotation of the web winding roller 22, and a driving time setting key 42 for setting a driving time for the motor for rotating the web winding roller 22 during which the web winding roller 22 is driven to rotate to wind the web 18. The signals generated by the web winding start timing setting key 40 and the driving time setting key 42 are also input to the CPU 28 for controlling the motor 32.

Hereinafter, a control of the web winding roller 22 is described referring to FIGS. 2 and 3. As described earlier, a portion of the web 18 is brought into contact with the rotating heating roller 15 with a pressure applied by the pushing roller 24 as shown in FIG. 2. During a fixing operation, the heating roller 15 is rotated for fixing a toner image on a passing copysheet 50. Therefore, toner adhering onto the heating roller 15 is scraped off by the portion of the web 18 contacting the heating roller 15. When a same portion of the web 18 is continuously used for cleaning the heating roller 15 as described above, the portion of the web 18 contacting the heating roller 15 is generally stained with the toner and reaches a state that the web 18 does not clean the heating roller 15 any more. Therefore, the portion of the web 18 contacting the heating roller 15 must be changed with another portion thereof after a predetermined number of copies are made. Accordingly, the web 18 is wound by the web winding roller 22 by rotating the web winding roller 22.

The web winding roller 22 rotates a predetermined period of time to wind a predetermined length of the web 18, for example 0.5 millimeter, every time when the motor 32 for rotating the web winding roller 22 is activated. However, if the web 18 is wound during a rotation of the heating roller 15, a toner leakage occurs as described above. Therefore, the controller 60 controls rotation of the web winding roller 22 to avoid toner leakage from a cleaning area in a manner as described below.

When a predetermined number of copies stored in the ROM 61 have been made, and if the rotation signal generated by the rotation sensor 30 indicates that the heating roller 15 is rotating, the CPU 28 controls the motor 32 for rotating the web winding roller 22 not to drive.

On the other hand, if the rotation signal generated by the rotation sensor 30 indicates that the heating roller 15 is not rotating and the rotation signal is output to the CPU 28, the CPU 28 controls the motor 32 to start driving so that the contact portion of the web 18 contacting the heating roller 15 is changed.

Accordingly, the web 18 is not wound by the web winding roller 22 when the heating roller 15 is being rotated to fix the toner image on the copysheet 50. Namely, the contact portion of the web 18 contacting the heating roller 15 is not moved during rotation of the heating roller 15. Therefore, vibration of the heating roller 15 and/or the pushing roller 24, which occurs when the web 18 is wound while the heating roller 15 is rotating in an opposite direction to the web 18, does not occur. Accordingly a gap is never created at a contacting portion between the pushing roller 24 and the heating roller 15. Therefore, residual toner 34 remaining at the cleaning area (see FIG. 2) is not forced to be pulled out by the rotational force of the heating roller 15 through the gap to fall on a copysheet 50 passing through the fixing device 8. Thus, damaging of an image on a next copysheet 50 is avoided.

Further, because the web 18 is wound only when the heating roller 15 is not rotating, a strong pressing force against the heating roller 15 is not necessary for suppressing toner leakage. Therefore, a pushing force of the spring member 26 for pushing the web 18 against the heating roller 15 can be made as weak as possible as long as an allowable performance of cleaning of the heating roller 15 is obtained. As a result, transformation of the rubber of the pushing roller 24 which otherwise occurs can be avoided, and thereby, a lifetime of the pushing roller 24 is lengthened.

Further, a torque of the motor 32 for driving the web winding roller 22 can be suppressed for the same reason. As a result, consumption of electricity for the motor 32 is made minimum.

Hereinafter, an emergency control of the web winding roller 22 is explained referring to FIG. 4.

During winding of the web 18 by the web winding roller 22, an excessive physical load may be put on the motor 32 for rotating the web winding roller 22 if, for example, a large amount of toner scraped off the heating roller 15 has been deposited and a part of such toner has been clogged between the heating roller 15 and the web 18; as a result, the web 18 becomes difficult to wind. If an excessive load is given to the motor 32 by such a clogging of the toner, an image forming operation must be stopped to avoid fixing a copysheet 50 by the heating roller 15 not entirely cleaned by the web 18. When it is difficult to wind the web 18 by the web winding roller 22 due to a load of the contact portion of the web 18 contacting the heating roller 15, the web 18 is not sufficiently changed such that a new portion thereof contacts the heating roller 15, and accordingly a surface of the heating roller 15 is not sufficiently cleaned by the web 18. As a result, a copy is stained by the heating roller 15 with toner remaining on the heating roller 15.

To solve such a problem, a predetermined electrical current level indicative of an abnormal current produced in a case of locking of the web winding roller 22, for example, is stored in the ROM 61 in the controller 60.

Figure 4:
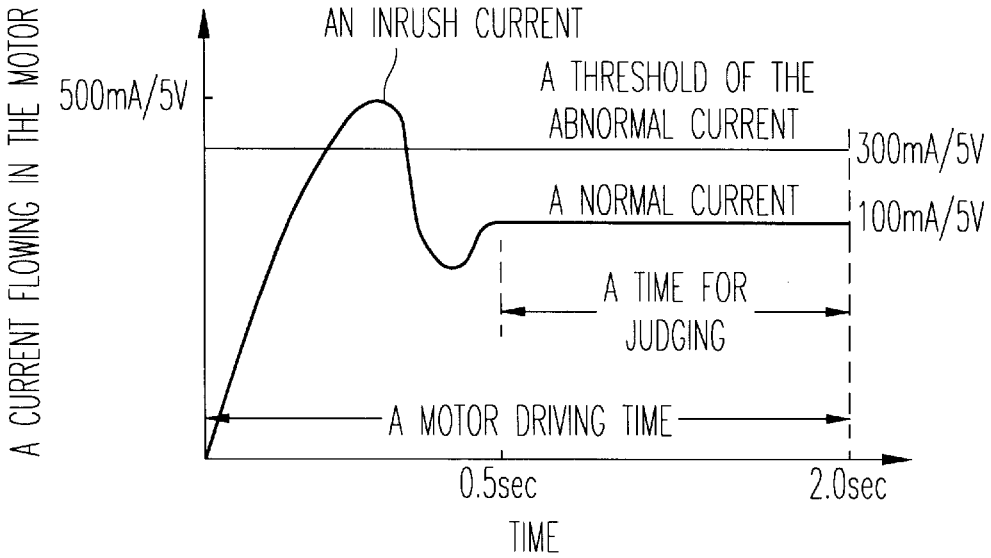
FIG. 4 is a graph showing a wave of an electrical current flowing in a motor for rotating a web winding roller of the cleaning device and an electrical current threshold level for determining if a current flowing in the driving motor is abnormal.

As shown in FIG. 4, an abnormal current level is set slightly lower than a peak of an inrush current of the motor 32, because, when a motor having a relatively small power is used for the motor 32 for rotating the web winding roller 22, a current level flowing in the motor in such a case, for example, is expected to be lower than a peak of an inrush current level flowing in the motor 32. When the current sensor 36 detects an abnormal current during driving of the motor 32 for winding the web 18 (i.e. motor driving time in FIG. 4), the CPU 28 controls the motor 32 for rotating the web winding roller 22 to stop driving. Further, the CPU 28 sends a signal indicative of an emergency stop of an operation to a display 70 disposed on the operation panel 38 (FIG. 3) so that a user can correct the state causing such an abnormal current, for example, by breaking the toner clog existing in the cleaning area or calling a service person for service.

Hereinafter, another control of the web winding roller 22 is explained referring to FIG. 4.

Figure 8:
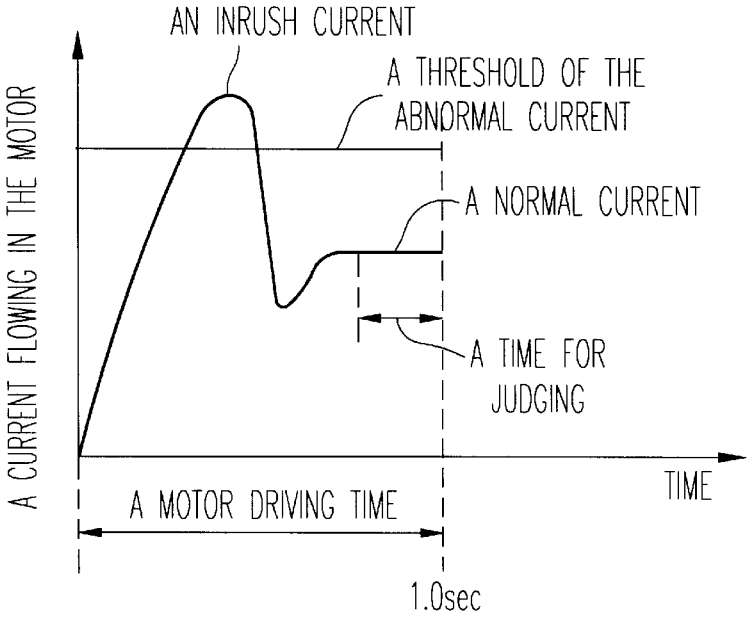
FIG. 8 BACKGROUND ART
FIG. 8 is a graph showing a wave of an electrical current flowing in a motor for rotating the web winding roller shown in FIG. 7 and an electrical threshold level for determining if a current flowing in the motor is abnormal.

In a web winding device, a web winding length is relatively short, because only a portion of the web 18 in the contact area between the heating roller 15 and the pushing roller 24 works to clean the heating roller 15 and the length of such a portion is relatively short. Accordingly, a driving time of the web winding roller 22 is short, for example, less than 1 sec per one winding of the web 18 by the web winding roller (see FIG. 8).

As described above, when a small motor having a driving force on an order of about a hundred to about a thousand rpm is employed for the motor 32 for rotating the web winding roller 22, an abnormal current level is set lower than and close to a peak of an inrush current. The inrush current generally does not disappear within 1 sec after the motor 32 commences its driving (see FIG. 8). Therefore, it is difficult to differentiate an inrush current from an abnormal current each flowing in the motor 32 during such a short period of time for the web winding by the motor 32. It may therefore occur that an inrush current is erroneously determined as an abnormal current, and thereby the motor 32 is unnecessarily stopped.

The above-described problem is solved by controlling the motor 32 for rotating the web winding roller 22 by the controller 60 in the following manner.

The motor 32 for rotating the web winding roller 22 is controlled by the controller 60 to rotate the web winding roller 22 to wind the web 18 by a predetermined length each time that the predetermined number of copies are completed as described earlier. For example, the motor 32 for rotating the web winding roller 22 is controlled by the CPU 28 to be driven for 1 sec to rotate the web winding roller 22 after every 1,000 copies are made.

The motor 32 for rotating the web winding roller 22 is further controlled by the CPU 28 such that a driving time of the motor 32 is extended from 1 sec to about 1.5 sec or about 2 sec, for example, after every predetermined number of times (e.g. three times) of winding of the web 18. The CPU 28 then controls the current sensor 36 not to sense a current flowing in the motor 32 for rotating the web winding roller 22 for a time corresponding to a time during which the inrush current disappears, for example, 0.5 sec (see FIG. 4).

By thus controlling the motor 32 and the current sensor 36, if an abnormal current exists, such a current can be easily detected by the current sensor 36 (see FIG. 3) because the inrush current disappears in the motor 32 before the current sensor 36 starts sensing.

Thus, even when an abnormal current occurs during a web winding and is lower than a peak of the inrush current, it can be differentiated from the inrush current by the CPU 28, and accordingly the motor 32 is precisely stopped by the CPU 28. Further, unnecessary stoppage of an operation of the fixing device due to mistakenly detecting the inrush current as the abnormal current is avoided.

A signal generated by the CPU 28 indicative of the abnormal current is output to the display 70 in the 25 operation panel 38 to activate the display 70 to inform the operator that the cleaning device 9 for the fixing device 8 is out of order (see FIG. 3).

An abnormal current also flows at the end of the winding of the web 18 by the web winding roller 22 and is also differentiated from the inrush current in a manner as mentioned above. Thereby, the end of the winding of the web 18 is detected by the controller 60. The reason why the abnormal current also flows at the end of the winding of the web 18 is that the web winding roller 22 is unable to wind the web 18 any more due to the connection of the end portion of the web 18 with the web roller 20, and accordingly a physical load occurs and is put on the motor 32 for rotating the web winding roller 22.

Hereinafter, another control of the web winding roller 22 is described referring to FIG. 3.

Generally, an operator who mainly makes copies of letter images will not want to change the web portion of the web 8 contacting the heating roller 15 as frequently as prescribed beforehand, because the quantity of toner on a letter image is less than that on a picture image and the heating roller 15 and the web 18 are not stained as much in the case of copying letter images. It is known to a person having ordinary skill in the art that if the contacting portion of the web 18 is frequently changed the heating roller 15 will always be kept cleaned, and if the contacting portion of the web 18 is changed by a longer length the heating roller 15 is well cleaned by the web 18 even if a large quantity of residual toner deposits in the cleaning area.

In such a case, therefore, through the web winding start timing setting key 40 and the driving time setting key 42 disposed on the operation panel 38, an operator can set a desired number of copies as a reference to start winding of the web 18 to change the contact portion of the web 18 and a desired driving period of time for driving the motor 32 to rotate the web winding roller 22 to wind the web 18 respectively. The CPU 28 can control the web winding roller 22 based on the newly set number of copies and/or the newly set driving time instead of the pre-set number of copies and the pre-set driving time. For example, when a driving time is newly set by the operator, the CPU 28 controls the motor 32 for rotating the web winding roller 22 to keep driving until the newly set driving time is elapsed. When a number of copies is newly set by the operator, the CPU 28 controls the motor 32 for the web winding roller 22 to start driving after the newly set number of copies is completed.

Thus, if the operator tends to make copies of letter images and accordingly the web 18 is not stained in a shorter period of time, he or she can change the pre-set number of copies or the pre-set driving time by setting a larger number of copies by the web winding start timing setting key 40 or by setting a shorter driving time by the driving time setting key 42. As a result, it is avoided that the portion of the web 18 contacting the heating roller 15 is unnecessarily changed, and consequently unnecessary consuming of the web 18 is avoided.

On the other hand, if the operator tends to make copies of picture images, and accordingly a large amount of the residual toner scraped by the web 18 deposits in the cleaning area, he or she can change the pre-set driving time by setting a smaller number of copies by the web winding start timing setting key 40 or by setting a longer driving time by the driving time setting key 42. As a result, the heating roller is always kept cleaned.

Hereinafter, a precise detection of an end of the web winding by the web winding roller 22 is explained.

Figure 5:
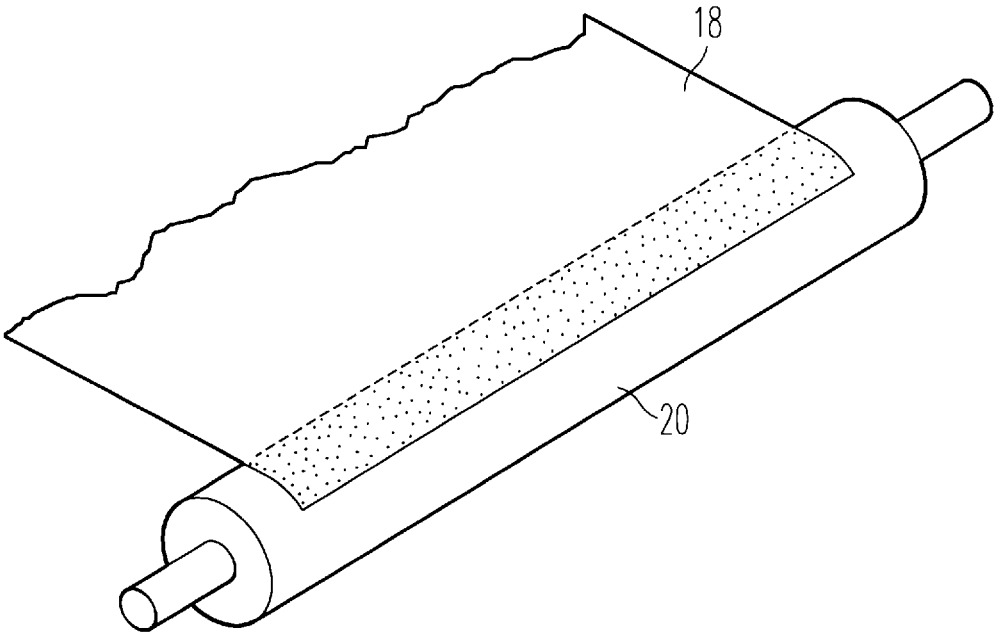
FIG. 5 is a perspective view showing an end portion of a web connecting with a web roller.
Figure 6:
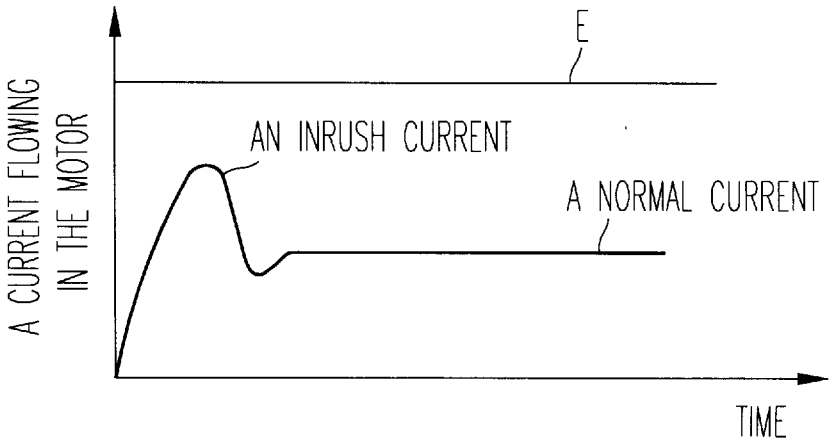
FIG. 6 is a graph showing a wave of an electrical current flowing in a motor for rotating a web winding roller and a threshold level at which the web starts peeling off the web roller.
Figure 7:
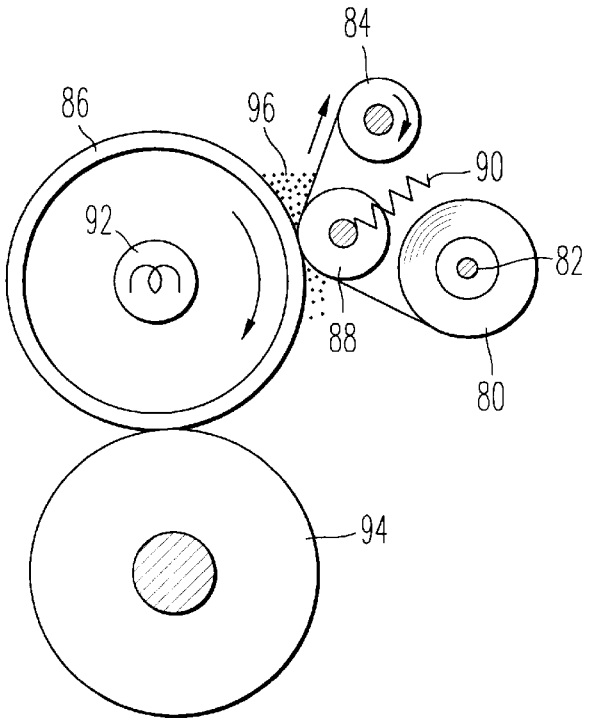
FIG. 7 BACKGROUND ART
FIG. 7 is a schematic sectional view showing a background web type cleaning device for a fixing roller.

As shown in FIG. 5, an end portion of the web 18 is adhered to the web roller 20 with an adhesive material. An adhesive force of the adhesive material for adhering the web 18 to the web roller 20 is determined in accordance with a driving force of the motor 32 when the current level (E) flows in the motor 32. In other words, the end portion of the web 18 is peeled off the web roller 20 by the driving force of the motor 32, when the current level (E) flows in the motor 32. Such an electrical current flowing in the motor 32 when the end portion of the web 18 is peeled off the web roll 20 is set to the level (E) slightly higher than the inrush current as shown in FIG. 6, and is stored in the ROM 61 of the controller 60 (see FIG. 3).

Therefore, if the current detected by the sensor 36 exceeds the level (E), the CPU 28 controls the motor 32 for rotating the web winding roller 22 to stop driving the web winding roller 32 to avoid unnecessary driving of the motor 32.

Further, the end of the web winding is indicated by a mark on the display 71 on the operation panel 38 (see FIG. 3) to inform an operator that the web winding is completed so that the user can change the used web roll with a new web roll.

For the same reason, needless stopping of the motor 32 for rotating the web winding roller 22 due to mistakenly sensing an inrush current as the current flowing at the end of the web winding can be avoided. Because the current level E is set higher than the peak of the inrush current, the web end detection is precisely performed.

Further, the user does not need to manually peel off the end portion of the web 18 from the web roll 20 because the end portion of the web 18 has been automatically peeled off the web roll 20, when the end of the winding is indicated on the display 38.

Obviously, numerous additional modifications and variations of the present invention are possible in light of the above teachings. It is therefore to be understood that within the scope of the appended claims, the present invention may be practiced otherwise than as specifically described herein.

The present application is based on Japanese Priority Document 8-180966, the contents of which are incorporated herein by reference.

What is claimed as new and desired to be secured by Letters Patent of the United States is:

1. An image forming apparatus comprising:

a fixing device including a pair of rollers for fixing a toner image formed on a copysheet;

a cleaning device for cleaning a fixing roller, said cleaning device including:

a web roller having a web wounded therearound, a web winding roller for winding the web unwound from the web roller, a pushing member for pushing a part of the web unwound from the web roller and winding around the web winding roller against the fixing roller to contact the fixing roller; and a motor for rotating the web winding roller;

a sensor for sensing rotation of the fixing roller;

a counter for counting a number of copies made;

a timer for counting a time after the motor is activated; and a controller for controlling the motor to rotate the web winding roller when a predetermined number of copies are made and said sensor senses that the fixing roller is not rotating and to stop rotation of the web winding roller after a predetermined time elapses.

2. An image forming apparatus comprising:

a fixing device including a pair of rollers for fixing a toner image formed on a copysheet;

a cleaning device for cleaning a fixing roller, said cleaning device including:

a web roller having a web wound therearound, a web winding roller for winding the web unwound from the web roller, a pushing member for pushing a part of the web unwound from the web roller and winding around the web winding roller against the fixing roller to contact the fixing roller, and a motor for rotating the web winding roller;

a sensor for sensing rotation of the fixing roller;

a counter for counting a number of copies made;

a timer for counting a time after the motor is activated; and a controller for controlling the motor to start rotation of the web winding roller when a predetermined number of copies are made, and to stop rotation of the web winding roller after a predetermined time elapses, wherein said controller periodically controls the motor to rotate the web winding roller for a longer time than the predetermined time, and controls a current sensor to start sensing a current flowing in the motor after the predetermined time elapses.

3. An image forming apparatus comprising:

a fixing device including a pair of rollers for fixing a toner image formed on a copysheet;

a cleaning device for cleaning a fixing roller, said cleaning device including:

a web roller having a web wound therearound, a web winding roller for winding the web unwound from the web roller, a pushing member for pushing a part of the web unwound from the web roller and winding around the web winding roller against the fixing roller to contact the fixing roller, and a motor for rotating the web winding roller;

a sensor for sensing a current flowing in the motor;

a counter for counting a number of copies made;

a timer for counting a time after the motor is activated; and a controller for controlling the motor to rotate and to stop the web winding roller, wherein an end portion of the web adheres to the web roller by an adhesive material with a predetermined adhesive force, and the controller controls the motor for rotating the web winding roller to stop rotation when a current corresponding to the adhesive force is sensed by the sensor.

4. The device as claimed in claim 3, further comprising:

a display for displaying a mark indicative of an abnormal current flowing in the motor for rotating the web winding roller when a current above a threshold level flows in the motor.

5. A web type cleaning device for use in an image forming apparatus for cleaning a fixing roller of a fixing device for fixing a toner image formed on a copysheet, comprising:

a web roller having a web wound therearound;

a web winding roller for winding the web unwound from the web roller;

a pushing member for pushing a part of the web unwound from the web roller and winding around the web winding roller against the fixing roller to contact the fixing roller with a predetermined pressure;

a motor for rotating the web winding roller;

a sensor for sensing rotation of the fixing roller;

a counter for counting a number of copies made;

a timer for counting a time after the motor is activated;

a controller for controlling the motor to rotate the web winding roller when a predetermined number of copies are made and said sensor senses that the fixing roller is not rotating and to stop rotation of the web winding roller after a predetermined time elapses.

6. The device as claimed in claim 5, wherein said pushing member pushes the part of the web with a minimum predetermined pressure required for cleaning the fixing roller.

7. The device as claimed in claim 5, wherein said motor has a power force in an order of about a hundred to about a thousand rpm.

8. The device as claimed in claim 5, wherein a current threshold level for determining if a current flowing in the motor is an abnormal current by the controller is set lower than a peak of an inrush current of the motor.

9. A web type cleaning device for cleaning a fixing roller of a fixing device for use in an image forming apparatus for fixing a toner image formed on a copysheet for use in an image forming apparatus, comprising:

a web roller having a web wound therearound;

a web winding roller for winding the web unwound from the web roller;

a pushing member for pushing the web unwound from the web roller and winding around the web winding roller against the fixing roller to contact the fixing roller with a predetermined pressure;

a motor for rotating the web winding roller;

a current sensor for sensing a current flowing in the motor for rotating the web winding roller;

a counter for counting a number of copies made by the image forming apparatus;

a timer for counting a time after the motor is activated;

a controller for controlling the motor to start rotation of the web winding roller when a predetermined number of copies are made and to stop rotation of the web winding roller after a predetermined time elapses, wherein said controller periodically controls the motor to rotate the web winding roller for a longer time than the predetermined time, and controls the current sensor to start sensing a current flowing in the motor after the predetermined time elapses.

10. The device as claimed in claim 9, wherein said predetermined time after which the current sensor starts sensing of the current flowing in the motor is a time during which an inrush current disappears in the motor for rotating the web winding roller.

11. The device as claimed in claim 9, wherein said longer time than the predetermined time is a time during which the controller can differentiate an abnormal current from an inrush current flowing in the motor for the web winding roller.

12. The device as claimed in claim 9, wherein said motor has a power force in an order of about a hundred to about a thousand rpm.

13. The device as claimed in claim 9, further comprising:

a driving time setting means for setting a driving time of the motor for rotating the web winding roller.

14. The device as claimed in claim 9, further comprising:

a web winding start timing setting means for setting a number of copies as a reference for activating the motor for rotating the web winding roller.

15. The device as claimed in claim 9, wherein:

said controller controls the motor depending on a condition set by at least one of a driving time setting means and a winding start timing setting means.

16. A web type cleaning device for cleaning a fixing roller of a fixing device for fixing a toner image formed on a copysheet for use in an image forming apparatus comprising:

a web roller having a web wound thereon;

a web winding roller for winding the web unwound from the web roller;

a pushing member for pushing a part of the web unwound from the web roller and winding around the web winding roller against the fixing roller to contact the fixing roller with a predetermined pressure;

a motor for rotating the web winding roller;

a sensor for sensing a current flowing in the motor;

a counter for counting a number of copies made by the image forming apparatus;

a timer for counting a time after the motor is activated;

a controller for controlling the motor to rotate and to stop the web winding roller, wherein an end portion of the web is adhered to the web roller by an adhesive material with a predetermined adhesive force, and the controller controls the motor for rotating the web winding roller to stop rotation of the web winding roller when a current corresponding to the adhesive force is sensed by the sensor.

17. The device as claimed in claim 16, further comprising:

a display for displaying a mark indicative of an end of winding of the web by the web winding roller; and a display controller for controlling the display to display the mark when a current corresponding to the adhesive force is sensed by the sensor.

18. The device as claimed in claim 17, wherein said mark indicative of an end of winding of the web by the web winding roller is different from a mark indicative of an abnormal current flowing in the motor for rotating the web winding roller when a current flows above a threshold level in the motor.

19. The device as claimed in claim 16, wherein said current corresponding to the adhesive force of the adhesive material is set higher than an inrush current of the motor for rotating the web winding roller.

* * * * *